US008887427B2

(12) United States Patent
Zukowski et al.

(10) Patent No.: US 8,887,427 B2
(45) Date of Patent: Nov. 18, 2014

(54) EXTRACTOR FOR SELF-LOADING FIREARM

(71) Applicant: Smith & Wesson Corp., Springfield, MA (US)

(72) Inventors: Gary Zukowski, Ludlow, MA (US); Seth Joubert, Pascoag, RI (US)

(73) Assignee: Smith & Wesson Corp., Springfield, MA (US)

( * ) Notice: Subject to any disclaimer, the term of this patent is extended or adjusted under 35 U.S.C. 154(b) by 54 days.

(21) Appl. No.: 13/741,621

(22) Filed: Jan. 15, 2013

(65) Prior Publication Data

US 2014/0196339 A1 Jul. 17, 2014

(51) Int. Cl.
*F41A 15/08* (2006.01)
*F41A 15/00* (2006.01)
*F41A 3/12* (2006.01)

(52) U.S. Cl.
CPC .. *F41A 15/00* (2013.01); *F41A 3/12* (2013.01)
USPC ..... 42/46; 42/25; 42/68

(58) Field of Classification Search
CPC ..... F41A 15/14; F41A 15/12; F41A 15/10; F41A 15/08; F41A 15/00; F41A 9/54
USPC ..... 42/25, 46, 68
See application file for complete search history.

(56) References Cited

U.S. PATENT DOCUMENTS 1,401,552 A 12/1921 Pedersen
1,423,836 A 7/1922 Declaye
2,765,560 A * 10/1956 Linder ..... 42/25
3,561,396 A 2/1971 Luciani
3,608,223 A 9/1971 Dieckmann
3,830,000 A 8/1974 Browning
4,031,648 A 6/1977 Thomas
4,555,860 A * 12/1985 Zedrosser ..... 42/25
4,615,132 A 10/1986 Smith
4,883,213 A 11/1989 Almeras
4,920,676 A 5/1990 Peters
5,289,755 A 3/1994 Zielinski et al.
5,678,340 A 10/1997 Moon
5,794,373 A 8/1998 Moon
6,393,751 B1 5/2002 Liebenberg
6,851,212 B2 2/2005 Szabo
7,257,917 B1 8/2007 Garland
7,380,362 B2 * 6/2008 Curry et al. ..... 42/46
7,395,626 B2 7/2008 Zedrosser
7,874,240 B2 1/2011 Akhavan
7,971,380 B1 7/2011 Gussalli Beretta
2012/0167427 A1 7/2012 Zukowski et al.

* cited by examiner

*Primary Examiner* — Daniel J Troy
*Assistant Examiner* — John D Cooper
(74) *Attorney, Agent, or Firm* — John A. Chionchio; Ballard Spahr LLP

(57) ABSTRACT

An extractor for a self-loading firearm is mountable on a breech block and is formed of a body having a hook at one end. The body is pivotally mounted via a pivot pin. A surface is positioned between the pivot pin and the hook. The surface is divided into at least two surface portions offset from one another. One of the surface portions has a plurality of step surfaces offset from one another. The step surfaces are used to fix the bar dimension of the hook. The invention also encompasses a slide on which the extractor is mounted, as well as a self-loading firearm having the slide. A method of fitting the extractor to the pistol or slide is also disclosed.

44 Claims, 3 Drawing Sheets

EXTRACTOR FOR SELF-LOADING FIREARM

FIELD OF THE INVENTION

The invention concerns an extractor for a self-loading firearm, a firearm and its components having such an extractor, and a method of fitting the extractor to the firearm.

BACKGROUND

Self-loading or "automatic" pistols use an extractor to remove a spent casing (during operation) or live round from the chamber of the pistol. The extractor is mounted on the breech block, which may be part of the slide for pistols such as the Model 1911 which have a slide. The extractor has a hook that engages a groove in the base of the cartridge. Engagement between the hook and cartridge extracts the cartridge (or spent casing) when the breech block separates from the breech, either during operation or when the slide is "racked", or moved from battery to open position.

The "bar" dimension, the distance between the extractor hook and an opposite wall of the breech block, is important to ensure reliable operation of a self-loading pistol. If the bar dimension is too small, then stripping and chambering of a round during operation is inhibited. If the bar dimension is too large, then extraction of the spent casing is erratic. As is typical of machined parts comprising a mechanism, the dimensions of the parts will vary within an acceptable tolerance band. Dimensional tolerances on the extractor and the slide/breech block will combine (add or subtract) and affect the bar dimension. For some pistols, such as the Model 1911, the tolerance on the bar dimension is relatively small. To meet this tolerance, it is found advantageous to fit the extractor to the slide/breech block.

Fitting the extractor is a time consuming process whereby the armorer must assemble the extractor onto the slide/breech block, measure the bar dimension, and then adjust the size of the extractor by removing material from the extractor if the bar dimension is too large. This is done by a "cut and try" method, and requires considerable skill to effect efficiently, as several attempts may be required. Removal of material must be done with care, least the extractor dimension become too small, thereby rendering it useless. There is clearly a need for an extractor, and a method of fitting an extractor to a slide/breech block, which improves the efficiency of the process.

SUMMARY

In one example embodiment, the invention comprises an extractor mountable on a breech block of a self-loading firearm by means of a pivot pin. In this example the extractor comprises a body attachable to the breech block. The body has a hook positioned at one end thereof. An opening in the body is for receiving the pivot pin. A surface is positioned on the body between the opening and the hook. The surface comprises at least first and second surface portions. The first surface portion is offset relatively to the second surface portion. The first surface portion comprises at least first and second step surfaces. The first step surface is offset relatively to the second step surface. In one example embodiment, the first surface portion is positioned proximate to the hook. By way of example, the first step surface may also be positioned proximate to the hook.

In an example, the first step surface is offset from the second step surface from about 0.009 inches to about 0.003 inches. In a particular example embodiment, the first step surface is offset from the second step surface about 0.006 inches.

The invention also encompasses an extractor mountable on a breech block of a self-loading firearm. In this example embodiment, the extractor comprises a body attachable to the breech block. The body has a hook positioned at one end thereof. A pivot pin is mounted on the body for pivotally attaching the body to the breech block. A surface is positioned on the body between the pivot pin and the hook. The surface comprises at least first and second surface portions, the first surface portion being offset relatively to the second surface portion. In this example the first surface portion comprises a plurality of step surfaces including at least a first step surface, a second step surface, and a third step surface. The first step surface is offset relatively to the second step surface. The second step surface is offset relatively to the third step surface. In an example embodiment, the first step surface is offset from the second step surface by a first distance, and the second step surface is offset from the third step surface by a second distance, the first and second distances being equal to one another. By way of example, the first and second distances may range from about 0.009 inches to about 0.003 inches. In a particular example, the first and second distances are about 0.006 inches. In an example embodiment, the second step surface may be positioned between the first and the third step surfaces. The first surface portion may be positioned proximate to the hook, and the first step surface may also be positioned proximate to the hook.

The invention also encompasses an extractor mountable on a breech block of a self-loading firearm. In an example embodiment, the extractor comprises a body attachable to the breech block, the body having a hook positioned at one end thereof. A pivot pin is mounted on the body for pivotally attaching the body to the breech block. A surface is positioned on the body between the pivot pin and the hook. The surface comprises at least first and second surface portions. The first surface portion is offset relatively to the second surface portion in this example embodiment. The first surface portion comprises at least first and second step surfaces. The first step surface is offset relatively to the second step surface. In an example embodiment, the first surface portion is positioned proximate to the hook. The first step surface may also be positioned proximate to the hook.

In an example embodiment, the first step surface may be offset from the second step surface from about 0.009 inches to about 0.003 inches. In a particular embodiment, the first step surface is offset from the second step surface about 0.006 inches.

The invention encompasses another example embodiment of an extractor mountable on a breech block of a self-loading firearm by means of a pivot pin. In this example, the extractor comprises a body attachable to the breech block and having a hook positioned at one end thereof. An opening is positioned in said body for receiving the pivot pin. A surface is positioned on the body between the opening and the hook. The surface comprises at least first and second surface portions in this example. The first surface portion is offset relatively to the second surface portion. The first surface portion comprises a plurality of step surfaces including at least a first step surface, a second step surface, and a third step surface. The first step surface is offset relatively to the second step surface and the second step surface is offset relatively to the third step surface.

By way of example, the first step surface may be offset from the second step surface by a first distance, and the second step surface may be offset from the third step surface by a second distance, the first and second distances being equal to one another. In a further example, the first and second distances may range from about 0.009 inches to about 0.003 inches. In a particular example, the first and second distances are about 0.006 inches. The second step surface may be positioned between the first and the third step surfaces. The first surface portion may be positioned proximate to the hook, and the first step surface may also be positioned proximate to the hook in example embodiments of the invention.

The invention also encompasses a slide for a self-loading pistol. In an example embodiment, the slide comprises a breech block having a breech face. An extractor is mounted on the slide adjacent to the breech face. The extractor comprises a body having a longitudinal axis oriented transversely to the breech face. The body comprises a hook projecting beyond the breech face. A pivot pin is mounted on the slide. The pivot pin is oriented perpendicular to the longitudinal axis of the body. The body is pivotably mounted on the pivot pin. A surface is positioned on the body between the pivot pin and the hook. The surface comprises at least first and second surface portions. The first surface portion is offset toward the breech block relatively to the second surface portion. The first surface portion comprises at least first and second step surfaces. The first step surface is offset toward the breech block relatively to the second step surface. In some example embodiments, the first surface portion is positioned proximate to the hook, and the first step surface may also be positioned proximate to the hook. The first step surface may be offset from the second step surface from about 0.009 inches to about 0.003 inches. In a particular example embodiment, the first step surface is offset from the second step surface about 0.006 inches.

The inventions also encompasses a slide for a self-loading pistol. In an example embodiment, the slide comprises a breech block having a breech face. An extractor is mounted on the slide adjacent to the breech face. The extractor comprises a body having a longitudinal axis oriented transversely to the breech face. The body comprises a hook projecting beyond the breech face. A pivot pin is mounted on the slide. The pivot pin is oriented perpendicular to the longitudinal axis of the body, the body being pivotably mounted on the pivot pin. A surface is positioned on the body between the pivot pin and the hook. The surface comprises at least first and second surface portions. The first surface portion comprises a plurality of step surfaces including at least a first step surface, a second step surface, and a third step surface. The first step surface is offset toward the breech block relatively to the second step surface. The second step surface is offset toward the breech block relatively to the third step surface.

In an example embodiment, the first step surface is offset from the second step surface by a first distance, and the second step surface is offset from the third step surface by a second distance, the first and second distances being equal to one another. By way of example, the first and second distances range from about 0.009 inches to about 0.003 inches. In a particular embodiment, the first and second distances are about 0.006 inches. The second step surface may be positioned between the first and the third step surfaces. In a particular example embodiment, the first surface portion is positioned proximate to the hook and the first step surface is also positioned proximate to the hook.

The invention further comprises a self-loading pistol. In one example embodiment, the pistol comprises a slide having a breech block with a breech face. An extractor is mounted on the slide adjacent to the breech face. The extractor comprises a body having a longitudinal axis oriented transversely to the breech face. The body comprises a hook projecting beyond the breech face. A pivot pin is mounted on the slide. The pivot pin is oriented perpendicular to the longitudinal axis of the body. The body is pivotably mounted on the pivot pin. A surface is positioned on the body between the pivot pin and the hook. The surface comprises at least first and second surface portions. The first surface portion is offset toward the breech block relatively to the second surface portion. The first surface portion comprises at least first and second step surfaces. The first step surface is offset toward the breech block relatively to the second step surface.

The first surface portion may be positioned proximate to the hook in one example. The first step surface may also be positioned proximate to the hook. By way of further example, the first step surface may be offset from the second step surface from about 0.009 inches to about 0.003 inches. In a particular example, the first step surface is offset from the second step surface about 0.006 inches.

In another example embodiment, the self-loading pistol comprises a slide having a breech block with a breech face. An extractor is mounted on the slide adjacent to the breech face. The extractor comprises a body having a longitudinal axis oriented transversely to the breech face. The body comprises a hook projecting beyond the breech face. A pivot pin is mounted on the slide. The pivot pin is oriented perpendicular to the longitudinal axis of the body, the body being pivotably mounted on the pivot pin. A surface is positioned on the body between the pivot pin and the hook. The surface comprises at least first and second surface portions. The first surface portion is offset toward the breech block relatively to the second surface portion. The first surface portion comprises a plurality of step surfaces including at least a first step surface, a second step surface, and a third step surface. The first step surface is offset toward the breech block relatively to the second step surface, the second step surface is offset toward the breech block relatively to the third step surface.

By way of example, the first step surface is offset from the second step surface by a first distance, and the second step surface is offset from the third step surface by a second distance, the first and second distances being equal to one another. The first and second distances may range from about 0.009 inches to about 0.003 inches. In a particular example, the first and second distances are about 0.006 inches.

In an example embodiment, the second step surface is positioned between the first and the third step surfaces. The first surface portion may be positioned proximate to the hook, and the first step surface may also be positioned proximate to the hook.

The invention also encompasses a method for fitting an extractor to a slide of a self-loading pistol. In an example embodiment, the slide comprises a breech block having a breech face, and the extractor comprises a body having a longitudinal axis and a hook. A surface is positioned on the body, the surface comprising a plurality of step surfaces, each of the step surfaces being offset relatively to one another in this embodiment. One example method comprises:

- positioning the body on the slide adjacent to the breech block with the longitudinal axis oriented transversely to the breech face and the hook extending beyond the breech face, one of the step surfaces being in contact with the slide;
- measuring a distance between the hook and a point on the slide proximate to the breech face;
- comparing the distance with a desired distance;
- removing the one step surface in contact with the slide from the body if the distance is greater than the desired distance; and repeating the positioning, measuring, comparing and removing steps until the distance is less than or equal to the desired distance.

Removing the step surfaces may be effected by grinding in a particular example. Other removal methods include sanding, milling and filing. Further by way of example, removing the one step surface comprises reducing a thickness of the body by about 0.009 inches to about 0.003 inches. In a particular example, removing the one step surface comprises reducing a thickness of the body by about 0.006 inches. An equal thickness of the body may be removed upon each of the removing steps.

In another example embodiment of a method for fitting an extractor to a slide of a self-loading pistol, the slide comprises a breech block having a breech face and the extractor comprises a body having a longitudinal axis and a hook. A surface is positioned on the body, the surface comprising a plurality of step surfaces including at least a first step surface, a second step surface, and a third step surface. The first step surface is offset relatively to the second step surface, the second step surface is offset relatively to the third step surface. In this example embodiment, the method comprises:

positioning the body on the slide with the longitudinal axis oriented transversely to the breech face and the hook extending beyond the breech face, the first step surface being in contact with the slide;

measuring a distance between the hook and a point on the slide proximate to the breech face;

comparing the distance with a desired distance;

removing the first step surface from the body if the distance is greater than the desired distance;

positioning the body on the breech block with the longitudinal axis oriented transversely to the breech face and the hook extending beyond the breech face, the second step surface being in contact with the slide;

measuring a distance between the hook and a point on the slide proximate to the breech face;

comparing the distance with a desired distance;

removing the second step surface from the extractor if the distance is greater than the desired distance.

Removing the step surfaces may be effected by grinding by way of example. Other removal methods include sanding, milling and filing. Removing the first step surface may comprise, for example, reducing a thickness of the body by about 0.009 inches to about 0.003 inches. In a particular example, removing the first step surface comprises reducing a thickness of the body by about 0.006 inches. Removing the second step surface may comprise, for example, reducing a thickness of the body by about 0.009 inches to about 0.003 inches. In a particular example, removing the second step surface comprises reducing a thickness of the body by about 0.006 inches. In a further example, an equal thickness of the body is removed upon removing each of the first and second step surfaces.

DETAILED DESCRIPTION

Figure 1:
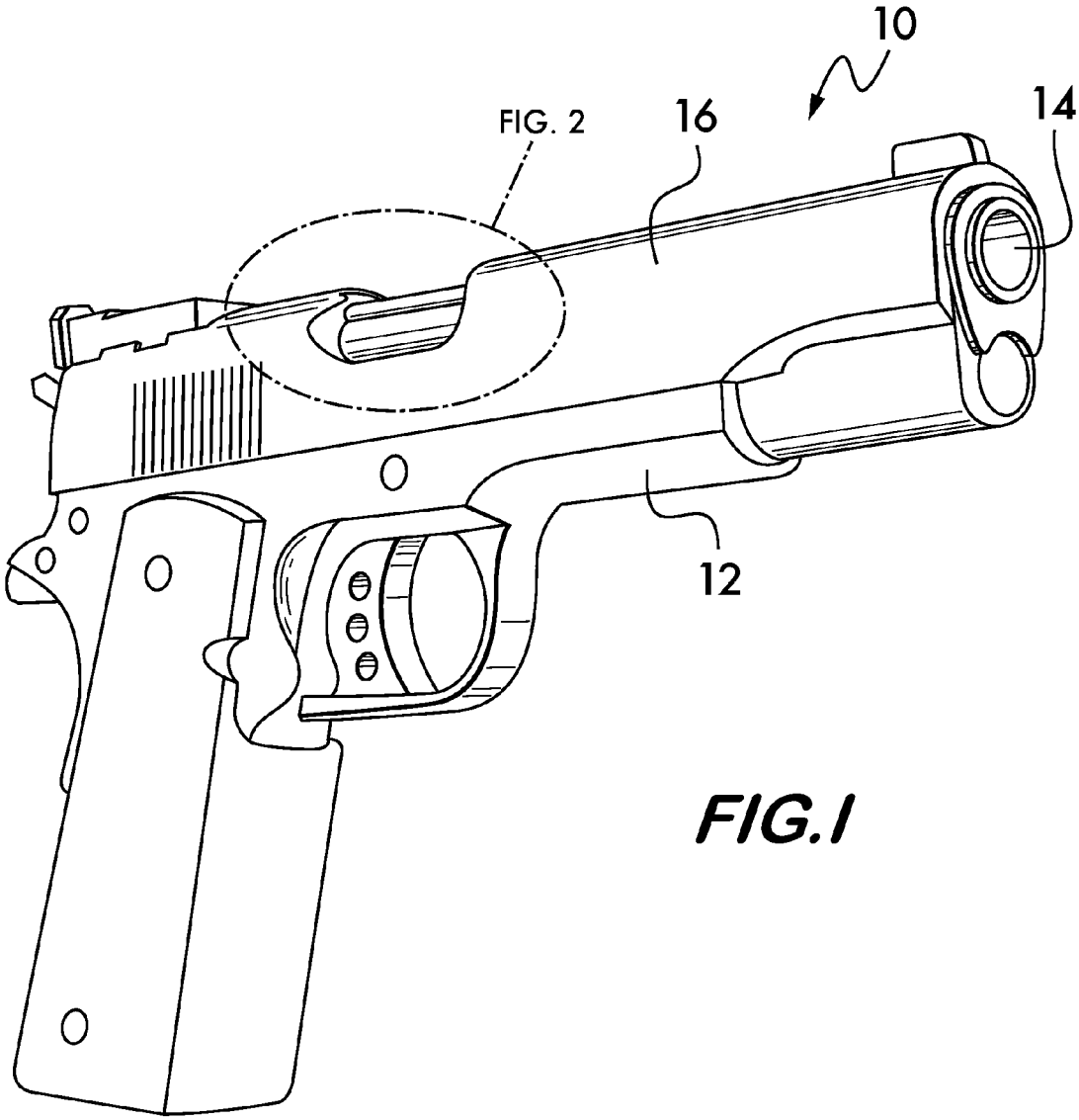
FIG. 1 is an isometric view of a self-loading firearm.
Figure 2:
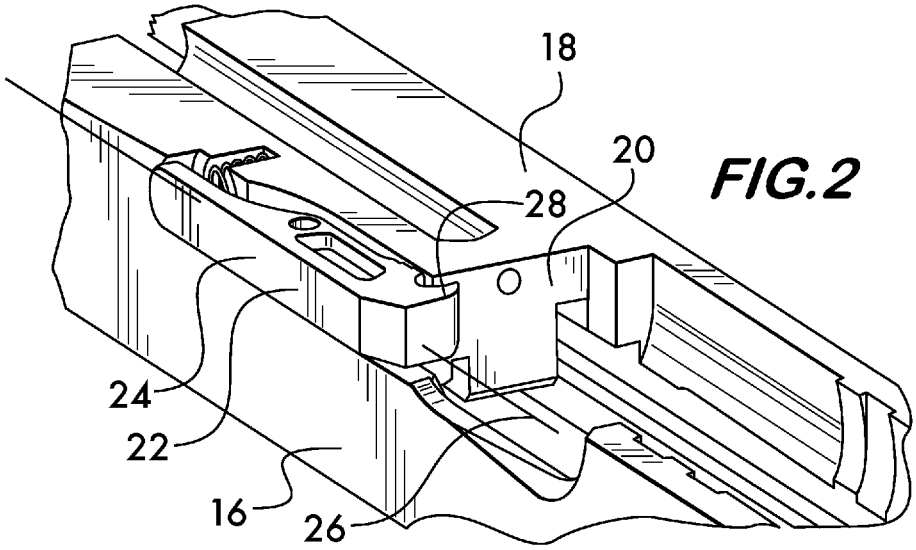
FIG. 2 is a partial sectional isometric view of a portion of the slide and breech block of the firearm shown within the broken line circle in FIG. 1.

FIG. 1 shows an isometric view of a self-loading firearm 10, in this example a pistol. Pistol 10 comprises a frame 12 on which are mounted a barrel 14 and a slide 16. As shown in FIG. 2, slide 16 comprises a breech block 18 having a breech face 20. An extractor 22 is mounted on the slide 16/breech block 18. Extractor 22 comprises a body 24 having a longitudinal axis 26 oriented transversely to the breech face 20. A hook 28 is positioned at one end of the body 24 and projects beyond the breech face 20.

Figure 3:
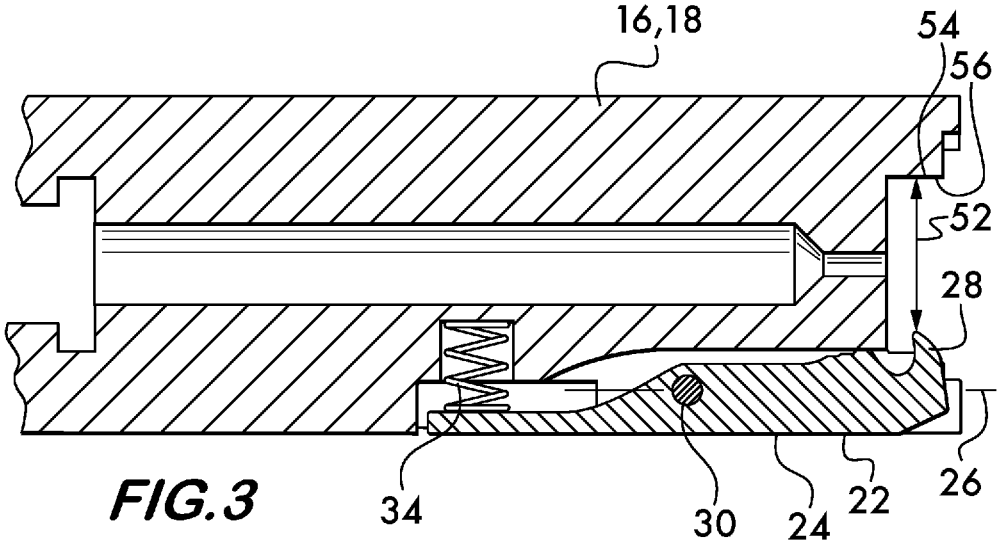
FIG. 3 is a longitudinal section view of the breech block and extractor shown in FIGS. 2 and 3.

As shown in FIG. 3, body 24 of extractor 22 is mounted to the slide 16/breech block 18 via a pivot pin 30. Pivot pin 30 may be integrally formed with body 24 or it may be a separate component received within an opening 32 in body 24 (see FIG. 4). Pivot pin 30 is oriented perpendicular to the longitudinal axis 26 of the body 24 to permit pivoting motion of the body relative to the slide 16/breech block 18. A spring element 34 is positioned between the body 24 and the slide 16/breech block 18 to bias the hook 28 toward the breech block 18.

Figure 4:
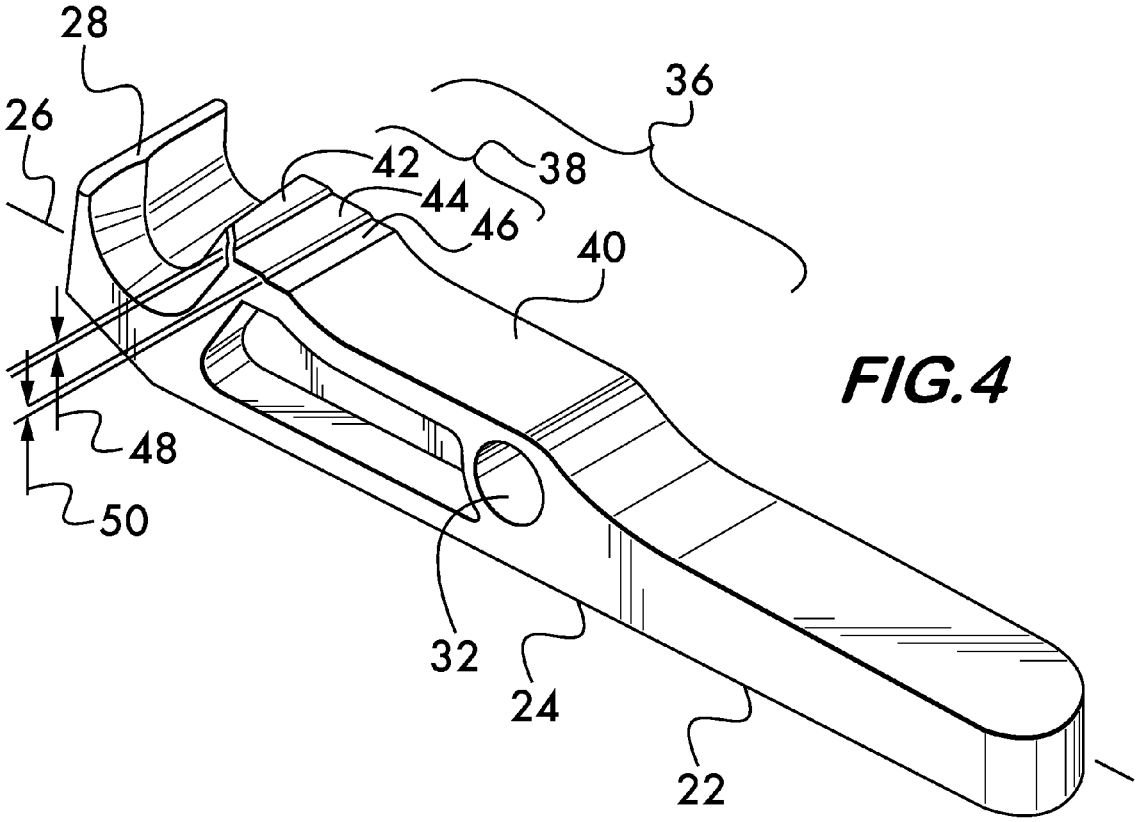
FIG. 4 is an isometric view of an example extractor according to the invention.

FIG. 4 shows the extractor 22 in detail. Body 24 comprises a surface 36 positioned between the pivot pin 30 (or opening 32) and the hook 28. Surface 36 is divided into first and second surface portions 38 and 40. Surface portion 38, in this example embodiment, positioned proximate to the hook 28, is offset relatively to the surface portion 40. Surface portion 38 is further divided into step surfaces, in this example, first, second and third step surfaces 42, 44 and 46. In the embodiment shown, the first step surface 42 is positioned proximate to the hook 28. The respective offset distances 48 and 50 between the step surfaces 42 and 44 and 44 and 46 may range from about 0.009 inches to about 0.003 inches. It has been found advantageous to have the offset distances equal to one another, at a distance of about 0.006 inches for practical purposes as explained below.

As shown in FIG. 3, when the body 24 of the extractor 22 is mounted on the slide 16/breech block 18, surface 36, and, consequently, the step surfaces 42, 44 and 46, face the breech block 18 (these surfaces are not numbered for clarity in FIG. 3). The spring element 34 biases one of the step surfaces into contact with the breech block 18. In FIG. 3, step surface 42 is shown in contact with the breech block. When in the configuration shown in FIG. 3, with one of the step surfaces in contact with the breech block 18, it is desirable that the distance 52 between the hook 28 and a point 54 the opposite wall 56 of the breech block 18 (known as the "bar" dimension) be held within a specified tolerance. The tolerance will depend on the particular pistol 10. For an .45 caliber pistol such as the Model 1911 for example, the acceptable tolerance on the bar dimension 52 is +/−0.003 inches. This tolerance range helps to ensure reliable extraction and feeding of the ammunition during operation.

Pistol 10 operates on the locked breech recoil principle, wherein recoil energy from the discharging round is harnessed to extract and eject the spent casing from the barrel chamber, cock the hammer, and strip a round from the magazine and chamber it in the barrel. Immediately upon discharge of a round, the breech block and barrel, being initially locked together, recoil together relatively to the frame over a short distance in a direction opposite to the direction of discharge. Motion of the barrel is then hafted, and the breech block separates from the barrel. The hook of the extractor is engaged with a groove in the base of the casing, and as the breech block separates from the barrel the hook extracts the spent casing from the chamber. The casing is ejected to one side by the asymmetrical pull of the extractor. The breech block continues its motion away from the barrel, cocking the hammer. The kinetic energy of the breech block is captured by a recoil spring, which then moves the breech block in the opposite direction toward the barrel. During this motion the breech block passes over the magazine, from which it strips the next round to be chambered. As the breech block moves toward the barrel it forces the next round into the chamber of the barrel. The breech block and barrel lock together and move together over a short distance into the "battery" position from which the pistol was initially discharged. As the round is chambered the hook of the extractor engages the groove in the casing, pivoting as required to ensure proper engagement.

With reference again to FIG. 3, if the bar dimension 52 is smaller than the allowable tolerance, then stripping and chambering of the next round is inhibited. If the bar dimension 52 is larger than the allowable tolerance, then extraction of the spent casing is erratic. For pistols wherein the bar dimension tolerance is small, such as the Model 1911, the extractor 22 as manufactured is not an interchangeable part, but must be fit to each pistol to ensure that the bar dimension tolerance is met. Fitting the extractor requires that an extractor be mounted on the slide 16/breech block 18, the bar distance measured, and then, if the bar dimension is too large, the extractor must be removed and material must be removed from the surface portion 38 which contacts the breech block 18. This procedure is repeated until either the bar dimension is within the tolerance or the bar dimension is too small (because too much material was removed), in which case the extractor is discarded and the process is repeated with a new extractor.

The process of fitting and extractor to a slide 16/breech block 18 is improved through the use of the extractor 22 according to the invention. By using a plurality of step surfaces 42, 44, 46 on the surface portion 38 as shown in FIG. 4, an armorer can readily remove a known amount of material from the surface portion 38 without the need for measuring the thickness of the extractor 22. When each step surface has a known offset dimension, the armorer can visually determine how much material has been removed, or is available for removal. Elimination of the measuring step greatly simplifies the extractor fitting process and allows fitting of the extractor in the field, using a go-no go gauge rather than a micrometer or calipers to measure the bar dimension 52.

The invention also encompasses a method for fitting an extractor as described above to a slide/breech block of a self-loading pistol. In one example embodiment, the method comprises:

positioning the extractor body 24 on the slide 16 adjacent to the breech block 18 with its longitudinal axis 16 oriented transversely to the breech 20 and the hook extending beyond the breech face, one of the step surfaces 42 being in contact with the slide;

measuring the bar dimension (distance 52) between the hook and a point on the slide proximate to the breech face (i.e., the opposite wall 54 of the breech block 18);

comparing the bar dimension (distance 54) with a desired distance;

removing one step surface (42) in contact with the slide 16 from the body 24 if the bar dimension (distance 52) is greater than the desired distance; and repeating the positioning, measuring, comparing and removing steps until the bar dimension (distance 52) is less than or equal to the desired distance.

In a practical example, the extractor 22 may have three step surfaces 42, 44 and 46 as shown in FIG. 3. An example method used with this extractor comprises the following steps:

positioning the body 24 of the extractor 22 on the slide 16 with the longitudinal axis 26 oriented transversely to the breech face 20 with the hook 28 extending beyond the breech face, the first step surface 42 being in contact with the slide;

measuring the bar distance 52 between the hook 28 and a point 54 on the slide proximate to the breech face;

comparing the distance with a desired distance;

removing the first step surface 42 from the body if the distance is greater than the desired distance;

positioning the body 24 on the slide 16 with the longitudinal axis 26 oriented transversely to the breech face 20 with the hook extending beyond the breech face, the second step surface 44 being in contact with the slide;

measuring a distance between the hook 28 and the point 54 on the slide 16 proximate to the breech face 20;

comparing the distance with the desired distance;

removing the second step surface 44 from the extractor 22 if the distance is greater than the desired distance.

Removal of the step surfaces is effectively accomplished by grinding. Sanding, milling and filing may also be used to remove the step surface. For practical extractors, the offset 48, 50 of the step surfaces may range between about 0.009 inches to about 0.003 inches. Thus, as each step surface is removed, the body 24 is reduced in thickness by about 0.009 inches to about 0.003 inches depending on the size of the offset. For a Model 1911 pistol having a bar distance tolerance of about +/−0.003 inches, a step surface offset of about 0.006 inches is advantageous. While the offset distances are all equal to one another in this example, they could also have different values.

What is claimed is:

1. An extractor mountable on a breech block of a self-loading firearm using a pivot pin mounted on said breech block, said extractor comprising:

a body having a hook positioned at one end thereof, said hook being adapted to engage a cartridge casing;

an opening in said body for receiving said pivot pin;

a surface positioned on said body between said opening and said hook, said surface facing said breech block when said body is attached thereto, said surface comprising at least first and second surface portions, said first surface portion positioned proximate to said hook and being offset relatively to said second surface portion in a direction toward said breech block when said body is attached thereto, said first surface portion comprising at least first and second step surfaces, said first step surface being offset relatively to said second step surface in said direction toward said breech block when said body is attached thereto.

2. The extractor according to claim 1, wherein said first step surface is positioned proximate to said hook.

3. The extractor according to claim 1, wherein said first step surface is offset from said second step surface from 0.009 inches to 0.003 inches.

4. The extractor according to claim 1, wherein said first step surface is offset from said second step surface 0.006 inches.

5. An extractor mountable on a breech block of a self-loading firearm, said extractor comprising:

a body having a hook positioned at one end thereof, said hook being adapted to engage a cartridge casing;

a pivot pin mounted on said body for pivotally attaching said body to said breech block;

a surface positioned on said body between said pivot pin and said hook, said surface facing said breech block when said body is attached thereto, said surface comprising at least first and second surface portions, said first surface portion being offset relatively to said second surface portion in a direction toward said breech block when said body is attached thereto, said first surface portion comprising a plurality of step surfaces including at least a first step surface, a second step surface, and a third step surface, said first step surface being offset relatively to said second step surface in said direction toward said breech block when said body is attached thereto, said second step surface being offset relatively to said third step surface in said direction toward said breech block when said body is attached thereto.

6. The extractor according to claim 5, wherein said first step surface is offset from said second step surface by a first distance, and said second step surface is offset from said third step surface by a second distance, said first and second distances being equal to one another.

7. The extractor according to claim 6, wherein said first and second distances range from 0.009 inches to 0.003 inches.

8. The extractor according to claim 6, wherein said first and second distances are 0.006 inches.

9. The extractor according to claim 5, wherein said second step surface is positioned between said first and said third step surfaces.

10. The extractor according to claim 9, wherein said first surface portion is positioned proximate to said hook.

11. The extractor according to claim 10, wherein said first step surface is positioned proximate to said hook.

12. An extractor mountable on a breech block of a self-loading firearm, said extractor comprising:

a body having a hook positioned at one end thereof, said hook being adapted to engage a cartridge casing;

a pivot pin mounted on said body for pivotally attaching said body to said breech block;

a surface positioned on said body between said pivot pin and said hook, said surface facing said breech block when said body is attached thereto, said surface comprising at least first and second surface portions, said first surface portion positioned proximate to said hook and being offset relatively to said second surface portion in a direction toward said breech block when said body is attached thereto, said first surface portion comprising at least first and second step surfaces, said first step surface being offset relatively to said second step surface in said direction toward said breech block when said body is attached thereto.

13. The extractor according to claim 12, wherein said first step surface is positioned proximate to said hook.

14. The extractor according to claim 12, wherein said first step surface is offset from said second step surface from 0.009 inches to 0.003 inches.

15. The extractor according to claim 12, wherein said first step surface is offset from said second step surface 0.006 inches.

16. An extractor mountable on a breech block of a self-loading firearm using a pivot pin mounted on said breech block, said extractor comprising:

a body having a hook positioned at one end thereof, said hook being adapted to engage a cartridge casing;

an opening in said body for receiving said pivot pin;

a surface positioned on said body between said opening and said hook, said surface facing said breech block when said body is attached thereto, said surface comprising at least first and second surface portions, said first surface portion being offset relatively to said second surface portion in a direction toward said breech block when said body is attached thereto, said first surface portion comprising a plurality of step surfaces including at least a first step surface, a second step surface, and a third step surface, said first step surface being offset relatively to said second step surface in said direction toward said breech block when said body is attached thereto, said second step surface being offset relatively to said third step surface in said direction toward said breech block when said body is attached thereto.

17. The extractor according to claim 16, wherein said first step surface is offset from said second step surface by a first distance, and said second step surface is offset from said third step surface by a second distance, said first and second distances being equal to one another.

18. The extractor according to claim 17, wherein said first and second distances range from 0.009 inches to 0.003 inches.

19. The extractor according to claim 17, wherein said first and second distances are 0.006 inches.

20. The extractor according to claim 16, wherein said second step surface is positioned between said first and said third step surfaces.

21. The extractor according to claim 16, wherein said first surface portion is positioned proximate to said hook.

22. The extractor according to claim 21, wherein said first step surface is positioned proximate to said hook.

23. A slide for a self-loading pistol, said slide comprising:

a breech block having a breech face;

an extractor mounted on said slide adjacent to said breech face, said extractor comprising a body having a longitudinal axis oriented transversely to said breech face, said body comprising a hook projecting beyond said breech face;

a pivot pin mounted on said slide, said pivot pin being oriented perpendicular to said longitudinal axis of said body, said body being pivotably mounted on said pivot pin;

a surface positioned on said body between said pivot pin and said hook, said surface comprising at least first and second surface portions, said first surface portion being positioned proximate to said hook and offset toward said breech block relatively to said second surface portion, said first surface portion comprising at least first and second step surfaces, said first step surface being offset toward said breech block relatively to said second step surface.

24. The slide according to claim 23, wherein said first step surface is positioned proximate to said hook.

25. The slide according to claim 23, wherein said first step surface is offset from said second step surface from 0.009 inches to 0.003 inches.

26. The slide according to claim 23, wherein said first step surface is offset from said second step surface 0.006 inches.

27. A slide for a self-loading pistol, said slide comprising:

a breech block having a breech face;

an extractor mounted on said slide adjacent to said breech face, said extractor comprising a body having a longitudinal axis oriented transversely to said breech face, said body comprising a hook projecting beyond said breech face;

a pivot pin mounted on said slide, said pivot pin being oriented perpendicular to said longitudinal axis of said body, said body being pivotably mounted on said pivot pin;

a surface positioned on said body between said pivot pin and said hook, said surface comprising at least first and second surface portions, said first surface portion comprising a plurality of step surfaces including at least a first step surface, a second step surface, and a third step surface, said first step surface being offset toward said breech block relatively to said second step surface, said second step surface being offset toward said breech block relatively to said third step surface.

28. The slide according to claim 27, wherein said first step surface is offset from said second step surface by a first distance, and said second step surface is offset from said third step surface by a second distance, said first and second distances being equal to one another.

29. The slide according to claim 28, wherein said first and second distances range from 0.009 inches to 0.003 inches.

30. The slide according to claim 28, wherein said first and second distances are 0.006 inches.

31. The slide according to claim 27, wherein said second step surface is positioned between said first and said third step surfaces.

32. The slide according to claim 31, wherein said first surface portion is positioned proximate to said hook.

33. The slide according to claim 32, wherein said first step surface is positioned proximate to said hook.

34. A self-loading pistol, comprising:

a slide having a breech block with a breech face;

an extractor mounted on said slide adjacent to said breech face, said extractor comprising a body having a longitudinal axis oriented transversely to said breech face, said body comprising a hook projecting beyond said breech face;

a pivot pin mounted on said slide, said pivot pin being oriented perpendicular to said longitudinal axis of said body, said body being pivotably mounted on said pivot pin;

a surface positioned on said body between said pivot pin and said hook, said surface comprising at least first and second surface portions, said first surface portion being positioned proximate to said hook and offset toward said breech block relatively to said second surface portion, said first surface portion comprising at least first and second step surfaces, said first step surface being offset toward said breech block relatively to said second step surface.

35. The pistol according to claim 34, wherein said first step surface is positioned proximate to said hook.

36. The pistol according to claim 34, wherein said first step surface is offset from said second step surface from 0.009 inches to 0.003 inches.

37. The pistol according to claim 34, wherein said first step surface is offset from said second step surface 0.006 inches.

38. A self-loading pistol, comprising:

a slide having a breech block with a breech face;

an extractor mounted on said slide adjacent to said breech face, said extractor comprising a body having a longitudinal axis oriented transversely to said breech face, said body comprising a hook projecting beyond said breech face;

a pivot pin mounted on said slide, said pivot pin being oriented perpendicular to said longitudinal axis of said body, said body being pivotably mounted on said pivot pin;

a surface positioned on said body between said pivot pin and said hook, said surface comprising at least first and second surface portions, said first surface portion being offset toward said breech block relatively to said second surface portion, said first surface portion comprising a plurality of step surfaces including at least a first step surface, a second step surface, and a third step surface, said first step surface being offset toward said breech block relatively to said second step surface, said second step surface being offset toward said breech block relatively to said third step surface.

39. The pistol according to claim 38, wherein said first step surface is offset from said second step surface by a first distance, and said second step surface is offset from said third step surface by a second distance, said first and second distances being equal to one another.

40. The pistol according to claim 39, wherein said first and second distances range from 0.009 inches to 0.003 inches.

41. The pistol according to claim 39, wherein said first and second distances are 0.006 inches.

42. The pistol according to claim 38, wherein said second step surface is positioned between said first and said third step surfaces.

43. The pistol according to claim 42, wherein said first surface portion is positioned proximate to said hook.

44. The pistol according to claim 43, wherein said first step surface is positioned proximate to said hook.

* * * * *